US008152290B2

(12) United States Patent
Daniel et al.

(10) Patent No.: US 8,152,290 B2
(45) Date of Patent: Apr. 10, 2012

(54) CUSTOMIZATION OF CURABLE INK PRINTS BY MOLDING

(75) Inventors: Jurgen H. Daniel, San Franciso, CA (US); Steven E. Ready, Los Antos, CA (US)

(73) Assignees: Xerox Corporation, Norwalk, CT (US); Palo Alto Research Center Incorporated, Palo Alto, CA (US)

( * ) Notice: Subject to any disclaimer, the term of this patent is extended or adjusted under 35 U.S.C. 154(b) by 613 days.

(21) Appl. No.: 12/324,069

(22) Filed: Nov. 26, 2008

(65) Prior Publication Data

US 2010/0128096 A1 May 27, 2010

(51) Int. Cl.
*B41J 2/01* (2006.01)

(52) U.S. Cl. ..... 347/102

(58) Field of Classification Search ..... 347/17, 347/102, 104

See application file for complete search history.

(56) References Cited

U.S. PATENT DOCUMENTS

| | | | | |
|---|---|---|---|---|
| 3,713,938 | A | 1/1973 | Sutton | |
| 3,792,964 | A | 2/1974 | Chatterji | |
| 3,794,550 | A | 2/1974 | Taillie | |
| 3,811,828 | A | 5/1974 | Ohta et al. | |
| 3,874,962 | A | 4/1975 | Gersbeck et al. | |
| 4,606,962 | A | 8/1986 | Reylek et al. | |
| 5,121,139 | A | 6/1992 | Burke | |
| 5,182,606 | A * | 1/1993 | Yamamoto et al. | 399/335 |
| 5,212,526 | A | 5/1993 | Domoto et al. | |
| 5,267,005 | A | 11/1993 | Yamamoto et al. | |
| 5,380,769 | A | 1/1995 | Titterington et al. | |
| 5,389,958 | A | 2/1995 | Hui et al. | |
| 5,476,540 | A | 12/1995 | Shields et al. | |
| 5,499,088 | A * | 3/1996 | Menjo | 399/321 |
| 5,531,817 | A | 7/1996 | Shields et al. | |
| 5,554,212 | A | 9/1996 | Bui et al. | |
| 5,555,800 | A * | 9/1996 | Rice | 101/23 |
| 5,654,125 | A | 8/1997 | Fan et al. | |
| 5,662,574 | A | 9/1997 | Slotten | |
| 5,671,678 | A | 9/1997 | Bolte et al. | |
| 5,804,671 | A | 9/1998 | Dones et al. | |
| 5,889,076 | A | 3/1999 | Dones et al. | |
| 5,892,116 | A | 4/1999 | Weiss et al. | |
| 5,952,446 | A | 9/1999 | Krebaum | |
| 5,994,425 | A | 11/1999 | Narang et al. | |
| 6,239,189 | B1 | 5/2001 | Narayan et al. | |
| 6,316,517 | B1 | 11/2001 | Dones et al. | |
| 6,339,442 | B1 * | 1/2002 | Miyamoto et al. | 347/171 |
| 6,354,700 | B1 | 3/2002 | Roth | |
| 6,355,203 | B1 | 3/2002 | Charmes et al. | |

(Continued)

FOREIGN PATENT DOCUMENTS

JP 01133746 A 5/1989

(Continued)

*Primary Examiner* — Daniel Petkovsek
(74) *Attorney, Agent, or Firm* — Marger Johnson & McCollom PC

(57) ABSTRACT

A system has a print head to dispense ink onto a print surface to form a printed image, a molding surface to contact the ink to form an informational image in at least the surface of the ink, and a radiation source to solidify the ink into the printed and informational images. A method includes dispensing ink onto a print medium to form a printed image, pressing a molding surface onto the printed image to transfer an informational image onto the printed image, and solidify the ink into the printed and informational images.

8 Claims, 4 Drawing Sheets

U.S. PATENT DOCUMENTS

| | | | |
|---|---|---|---|
| 6,472,056 | B1 | 10/2002 | Rea et al. |
| 6,494,570 | B1 | 12/2002 | Snyder |
| 6,561,645 | B2 | 5/2003 | Miyamoto |
| 6,566,024 | B1 | 5/2003 | Bourdelais et al. |
| 6,586,492 | B1 | 7/2003 | Caiger et al. |
| 6,760,093 | B2 | 7/2004 | Kawabata et al. |
| 7,270,408 | B2 | 9/2007 | Odell |
| 7,323,498 | B2 | 1/2008 | Belelie |
| 7,501,015 | B2 | 3/2009 | Odell |
| 7,538,145 | B2 | 5/2009 | Belelie |
| 7,559,639 | B2 | 7/2009 | Belelie |
| 7,578,587 | B2 | 8/2009 | Belelie |
| 7,632,546 | B2 | 12/2009 | Odell |
| 7,683,102 | B2 | 3/2010 | Odell |
| 7,690,782 | B2 | 4/2010 | Odell |
| 2001/0004871 | A1 | 6/2001 | Johnson et al. |
| 2002/0158963 | A1 | 10/2002 | Dietze |
| 2003/0036587 | A1 | 2/2003 | Kozak |
| 2003/0086735 | A1 | 5/2003 | Payne et al. |
| 2004/0019128 | A1 | 1/2004 | Kondo |
| 2004/0057757 | A1 | 3/2004 | Payne et al. |
| 2004/0186263 | A1 | 9/2004 | Pavlin |
| 2004/0189773 | A1 | 9/2004 | Masumi et al. |
| 2004/0226463 | A1 | 11/2004 | DeMoore et al. |
| 2006/0066703 | A1 | 3/2006 | Kadomatsu et al. |
| 2006/0066704 | A1 | 3/2006 | Nishida |
| 2006/0090843 | A1 | 5/2006 | Steinhardt et al. |
| 2006/0115305 | A1 | 6/2006 | Lofthus et al. |
| 2006/0132570 | A1 | 6/2006 | Odell |
| 2006/0290760 | A1 | 12/2006 | German et al. |
| 2007/0120921 | A1 | 5/2007 | Carlini et al. |
| 2007/0120924 | A1 | 5/2007 | Odell et al. |
| 2007/0120930 | A1 | 5/2007 | Domoto et al. |
| 2008/0122914 | A1 | 5/2008 | Toma et al. |
| 2010/0033545 | A1 | 2/2010 | Caiger et al. |
| 2010/0053289 | A1 * | 3/2010 | Thompson ..... 347/102 |
| 2010/0212821 | A1 | 8/2010 | Grinberg et al. |

FOREIGN PATENT DOCUMENTS

| | | | |
|---|---|---|---|
| JP | 04251747 | A | 9/1992 |
| WO | WO9724364 | | 10/1997 |

* cited by examiner

CUSTOMIZATION OF CURABLE INK PRINTS BY MOLDING

RELATED CASES

Cross-reference is hereby made to the following U.S. Patent Applications, assigned to the assignee hereof: U.S. application Ser. No. 12/256,670, filed Oct. 23, 2008; U.S. application Ser. No. 12/256,684, filed Oct. 23, 2008; U.S. application Ser. No. 12/256,690, filed Oct. 23, 2008; U.S. application Ser. No. 11/291,284, filed Nov. 30, 2005, now U.S. Pat. No. 7,789,502, issued Sep. 7, 2010; and U.S. patent application Ser. No. 12/331,076, filed Dec. 9, 2008, abandoned Aug. 17, 2011.

INCORPORATION BY REFERENCE

The following documents are incorporated by reference in their entireties for the teachings therein: U.S. patent application Ser. No. 11/291,284, filed Nov. 30, 2008, now U.S. Pat. No. 7,789,502 B2, Issued Sep. 7, 2010; and U.S. patent application Ser. No. 11/466,687, filed Aug. 23, 2006, now U.S. Pat. No. 7,531,582 B2, issued May 12, 2009.

BACKGROUND

Some ink materials, such as phase-change or gel inks, may benefit from curing during the printing process. Curing may be accomplished in many ways. One method involves exposing the freshly-printed ink to radiation, such as ultraviolet (UV) light or other actinic radiation. Another approach would involve heat 'curing' or essentially just allowing the ink to cool and solidify.

Phase-change inks such as gel-based inks are substantially solvent free and therefore enable fast printing speeds because drying of the printed image is not required. Moreover, those inks can be printed onto a wide variety of surfaces because the ink solidifies upon surface impact due to the lower temperature of the print surface. The ink shows little de-wetting or spreading on a variety of print surfaces. However, these inks may have a high profile on the page, which in turn can cause problems as the print media upon which these inks are deposited move through the printing system. Further, their high viscosity on the print surface may result in the ink not spreading correctly in turn resulting in images having undesirable artifacts.

Therefore, these inks generally benefit from pressing or leveling the ink to lower the ink profile on the page, as well as spreading and filling in the printed features. While this is an added step in the printing process, it does correct some of the issues with regard to spreading and leveling the image. It is also possible to combine the leveling and curing processes, as disclosed in U.S. patent application Ser. No. 12/331,076, filed Dec. 9, 2008, abandoned Aug. 17, 2011. In this approach another surface is pressed onto the image during the curing process, achieving both leveling and curing simultaneously.

DETAILED DESCRIPTION OF THE EMBODIMENTS

Figure 1:
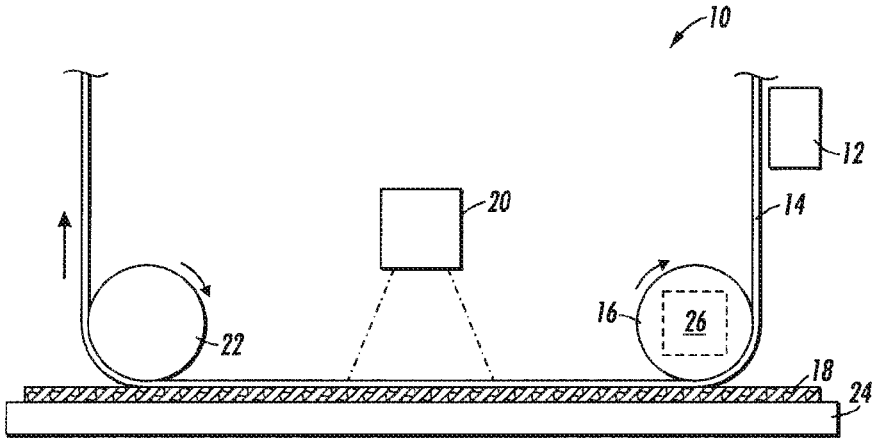
FIG. 1 shows an embodiment of a printing and molding system using a mechanical printer.

FIG. 1 shows an example of printing system 10 that includes a leveling, pressing or molding surface 14 that is used to level and pattern the ink layer 18 that is dispensed onto the print media 24. The ink layer 18 may be dispensed by inkjet printing, for example, and the layer may form an image or text or combination of both, all of which will be referred to here as the printed image. The ink layer may also be deposited by other printing methods such as flexographic printing, offset printing, gravure printing, screen printing or other known printing methods.

The printed image may consist of several colors. In one example, the ink layer consists of a phase-change ink such as a wax-based ink (e.g. Kemamide wax) or a gel-based ink. Phase-change inks have a low-viscosity when dispensed from a heated printhead and the viscosity increases rapidly when the ink makes contact with the cooler print surface or print media. Gel-ink is a liquid when heated that gelatinizes almost instantly upon contact with the cool print surface. Such inks are described for example in US Patent Application Publication No. 2008/0000384 A1. Note that the actual print head or printing apparatus is not shown in this drawing, but would typically reside to the right side of the drawing, prior to the print media coming into contact with the patterning portion of the system.

The print media 24 traverses the drawing from right to left. The pressing or leveling surface 14 which may be the surface of a belt, foil or tape as shown in FIG. 1 would typically be used to press against the image and cause the ink to spread and level out against the print media. The leveling process would even out any topographical variations which are due to the printing process, such as height variations of neighboring printed drops or lines, for example.

U.S. patent application Ser. No. 12/331,076, filed Dec. 9, 2008, abandoned Aug. 17, 2011 discloses such a system in which the leveling surface is substantially flat. In this embodiment, the pressing or leveling surface imparts a pattern into the uncured ink by pressing the pattern into the ink. This pressing or molding process causes the pressing or leveling surface to mold the ink layer and therefore this discussion will refer to the surface 14 as the molding surface. The molding process is possible if the inks have a certain height that may range from a few hundred nanometers to a few micrometers on the surface. This is the case with phase-change inks such as waxes or gel-based inks. In many water or solvent-based inks where only a thin layer of pigments remains on the print surface, such molding would be difficult to achieve or even be impossible.

The pattern may consist of several different types of information. These include watermarks used for document identification and security, serial/product numbers, logos, messages, symbols, hologram type imprints, Braille text, bar codes, two-dimensional bar codes or other information codes, acoustic patterns similar to the grooves on a phonograph, or textures of different types. In the example of acoustic patterns, the reader of the text or image may retrieve the acoustic information by moving a fingernail or a fine pen, etc, over the surface of the printed areas. Such simple acoustic information may augment the written text with simple audio information (e.g. a simple melody). A simple surface texture may also augment the information in a printed document by turning some areas of the document smooth and others rough or some areas glossy and others matte.

The pattern that is transferred into the ink layer may be only weakly visible in direct view or visible only at certain viewing angles or under special illumination conditions. The purpose of the pattern may be also just for touch sensation, such as in the case of Braille code. The pattern is a topographical pattern with step heights from 10s of nanometers up to several micrometers or more. The maximum height depends on the thickness of the ink layer and on the depth of the pattern in the molding surface. For some applications the height of the pattern may be tens or hundreds of micrometers which would require a thick deposited layer of ink.

The molding surface may be 'pre-loaded,' where the molding surface is manufactured in some other process and has a predetermined pattern to be molded into the ink. The molding surface may be patterned for example by a stamping or embossing process or by a laser ablation process or even by mechanical machining. Alternatively, it may be formed by depositing a material such as a polymer by a printing method such as inkjet printing. In one example, the molding surface may consist of a polyester foil into which a pattern was etched using 266 nm laser light. In another example, the molding surface consists of a polyester foil such as Mylar® onto which a pattern was inkjet printed using a solution of polyvinylcinnamate polymer with subsequent curing under UV light. In a third example, a polyetherimide foil is hot embossed with an aluminum master in order to form the molding surface. Various other materials may be used to form the molding surface, such as polyesters, copolyester, polysulfones, polyethersulfone, polymethylpentene, PVC, polyethylenenaphthalene, ethylene-chlorotrifluoroethylene, polycarbonate, polyetherimide, acetal copolymers, polyethyleneterephthalate and others. The materials may also include thin sheets of paper or fabric or thin glass, as well as other materials such as gelatin, silicone or combinations of layers of materials such as flexible glass coated with a polymer.

The formation of the molding surface envisions such markings as watermarks or company logos. Changing to a different pattern may involve having to use a separate molding surface for each printing job or run. The pattern is intended to communicate some sort of information and the image caused by the pattern may be referred to as the informational image.

Alternatively, the system may form the pattern in a more dynamic and changeable fashion. In the example of FIG. 1, a mechanical printer 12 forms the pattern on the surface of the molding surface by mechanical deformation of the surface. This may also be achieved by an arrangement in which the mechanical printer pushes from the back onto the molding surface to cause a deformation that is transferred to the other side (the molding side) of the material or tape. The mechanical printer 12 may consist of a dot matrix (impact) printer, a stamping system, etc. A stamping type system may allow for easier changing of the patterns, and a dot matrix or other type of impact printer would allow the pattern to be altered in near real-time. Any type of printing device that makes an impression or causes a deformation on the molding surface will be considered to be a mechanical printer. The printer 12 could also be a printer, such as an inkjet printer, that prints a pattern onto the surface 14. The pattern exhibits a topography and can then been used as a molding surface. For example, an inkjet printer may print a polymer pattern in which the polymer possesses a low surface energy in order to facilitate de-molding. In one example, the printed polymer is polymethylmethacrylate (PMMA).

The mechanical printer 12 would impart the pattern onto the molding surface 14. The molding surface 14 would then come into contact with the uncured ink layer 18 on the print media 24 guided by roller 16. The force between the print media 24 and the roller 16 plastically deforms the ink layer 18 or ink layer surface according to the pattern in the molding surface. Optionally, the roller 16 or/and the print media may be heated in order to facilitate the plastic deformation of the ink layer. As the molding surface contacts the ink layer, the radiation source 20 would then operate to cure the ink into the desired pattern through the molding surface. The molding surface 14 would typically be at least partially transparent, or at least translucent to allow transmission of the radiation from the radiation source 20. The radiation source may be a UV (ultraviolet) lamp, an infrared radiation source or other wavelength actinic light source. Other radiation such as electron beams may also be employed for curing.

If the print media 24 is transparent or translucent, then the radiation source 20 may be also located underneath the print media. Depending on the application, the print media may be paper, card board, plastics, wood, glass, metal, substrates for electronic products, such as silicon, etc. The molding surface may consist of a foil material such as Mylar®, paper, coated paper, flexible thin glass, etc. The height of the molded features depends on the applications and on the thickness of the ink layer. Typical features may be 10s of nanometers high up to several micrometers. Higher structures can be fabricated by depositing thicker ink layers and by using a molding surface with deeper topography.

After an appropriate period of time, during which a sufficient amount of radiation has cured the ink, the roller 22 would move the molding surface away from the now-cured ink layer 18 and the print media 24. Curing of the ink may occur by a chemical cross linking reaction of components within the ink. It should be noted, that the above described process applies to radiation curable inks. However, a molded pattern may also be forced onto a printout that was printed with a phase-change ink based on a simple thermal transition as in waxes such as Kemamide wax. In this case, a radiation curing step would not be required since the solidification of the ink is based simply on cooling of the ink. The molding or embossing process may be performed at an elevated temperature that slightly softens the wax or even melts the wax. A thermally induced cross linking reaction may also be a form of the curing process.

The molding surface may have a low surface energy to facilitate de-molding. This can be achieved by a release layer on the surface or by using low surface energy polymers as the materials that form the molding surface. Examples of low-surface energy materials are polytetrafluoroethylene (Teflon®) with a reported surface energy of 20 mN/m, polydimethylsiloxane (PDMS) with 19.8 mN/m, Polyvinylidene fluoride (PVDF) with 30.3 mN/m, plasma polymerized hexamethyldisiloxane (HMDS) with 38mN/m. Although low-surface energy coatings are often used as release layer, any other coating or surface deposit which adheres poorly to the molding surface or to the ink layer may be employed as a release layer. A release layer may be permanent or temporary and the release agent may consist of Cytop® from Asahi Glass (amorphous perfluoropolymer with high UV transmission) or DuPont's Teflon® AF fluoropolymer resin. These coatings may be deposited from solution, e.g. by dip-coating, spray coating, mist coating, doctorblading, printing methods or other deposition methods known in the art of solution processing.

Other permanent or temporary coatings may consist of ORMOCER® inorganic-organic hybrid polymers and they may also be coated from a solution. Instead of being just a thin surface layer, ORMOCERs may also form a thicker surface layer into which the mold pattern is transferred. Coatings that may be more suitable as permanent coatings are Parylene, in particular the fluorine group containing Parylene HT® manufactured by Specialty Coating Systems of Indianapolis, Ind., which may be deposited from a vapor phase. Moreover, a plasma coating such as by plasma polymerization from CHF3 gas or CF4/hydrocarbon mixtures or of hexafluoroacetone/hydrocarbon, such as acetylene, may form a permanent release layer.

Other potential release layers may be based on transparent superhydrophobic silica or on porous alumina coatings. Other release layers commonly used for releasing molds in molding processes may also be used. These include fluorinated coating, silicone-based coatings such as Sprayon® from Krylon of Cleveland, Ohio or materials such as Nano-MouldRelease by BPI Technology, Ltd. of Singapore. If the layer is permanently bonded to the molding surface, it may not have to be replaced after each print cycle. If the layer is temporarily applied, it may be freshly coated onto the leveling surface before contacting the ink and after release, the layer may be removed, such as by a solvent and mechanical wiping. Subsequently, a new layer of the release coating may be applied. After moving away from the print media and ink layer, the molding surface may travel through a return loop to be used again or, in the case of non-reusable or non-removable images on the molding surface, may travel to a take up roller. When the current roll of molding surface material is exhausted, the entire roll could be changed out.

Figure 2:
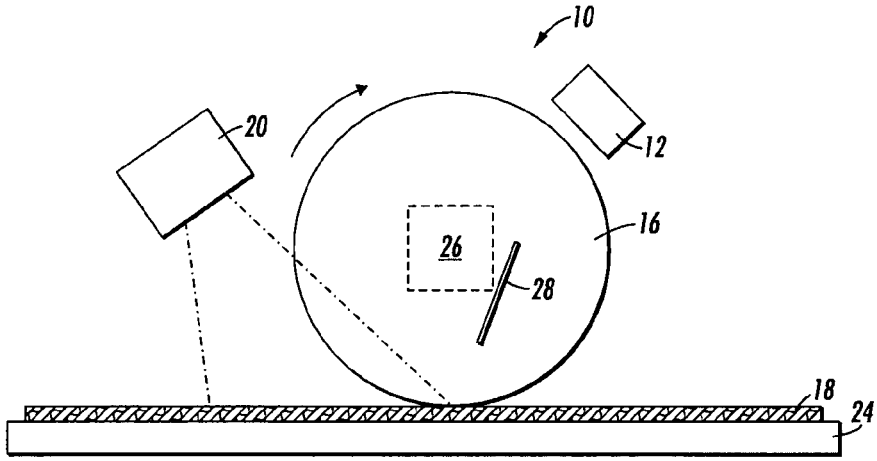
FIG. 2 shows an embodiment of a printing and molding system using a pressure roller.

In an alternative embodiment, the molding surface is directly on one of the rollers. FIG. 2 shows such an embodiment where the roller 16 contains the molding surface. The radiation source could be located inside the roller as shown in location 26, or adjacent to the roller as shown by 20. In this embodiment, if the light source were at location 20, the light source might be angled to allow light to cure the ink where it comes into contact with the roller. Similarly, if the light source were at location 26, a light shield 28 might be necessary to keep the light from striking and therefore curing the unpatterned ink to the right of the roller 16. It may be prudent to include the light shield 28 even if using the light source 20, to ensure that no light reaches the ink prior to the roller. In this scenario, the surface of the roller may have to be cleaned or reconditioned periodically. In order to change the mold pattern, the roller or roller surface has to be replaced. The release of the molded and cured print surface from the molding surface would occur from the rotation of the roller and the movement of the print surface away from the roller.

Figure 3:
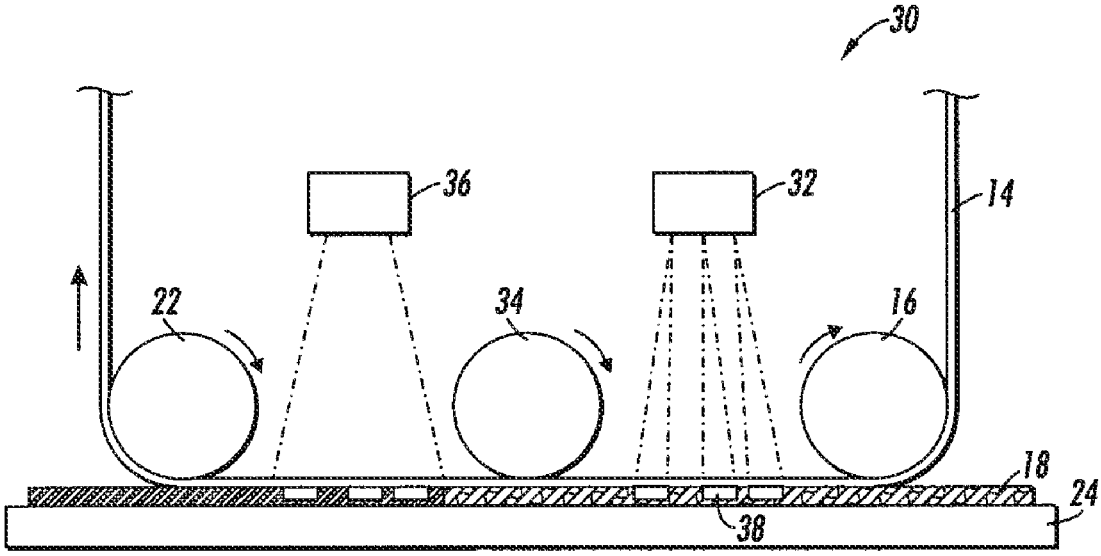
FIG. 3 shows an embodiment of a printing and molding system using a projected informational image.

Using a mechanical printer, laser patterning, inkjet printing of a mold pattern, stamping or machining of a mold pattern, etc., may result in the surface being only one-time usable, or only usable for a limited run. This would result in a system similar to the embodiment above, where the molding surface is pre-formed. One alternative would involve not actually imprinting the informational image onto the molding surface, but instead use a two-step process to form the informational image through the molding surface in one step, and then cure the remainder of the ink in a second step. In this case the molding surface would be flat and would not have to carry any topographical information image pattern. FIG. 3 shows an example of this type of system.

In FIG. 3, the printing system 30 employs 2 light sources. The print media transports the uncured ink layer 18 past the first roller 16, bringing the molding surface into contact with the ink layer. A first light source 32 transmits an image onto the ink layer through the molding surface 14. The molding surface may press against the ink layer at a first pressure during this exposure process. The light or radiation source 32 could be of any type of radiation that causes the ink to cure, the selection of the light source being largely dependent upon the nature of the ink. A typical example consists of ultraviolet (UV) light curable gel ink and a UV light source. In one example, the radiation source 32 is a light projector.

After the projector 32 forms the image on the ink layer, such as the pattern shown at 38, a second roller 34 may apply a second, higher pressure to move the molding surface against the print media 24. This would cause the ink in the non-imaged area, still uncured, to spread out further, deform further or get pushed into the print media further (in case of a porous medium such as paper) than the ink, the now-cured in the area imaged by the light source 32. This would result in a raised pattern of ink in the areas imaged by the light source 32, and regions of ink having a lower or otherwise deformed profile in the non-imaged areas.

The light source 36 then cures the remaining uncured or un-solidified ink in the lower regions. The light source 36 would generally accomplish this through a 'blank' exposure. The raised pattern of ink would form the informational image in this embodiment. After curing, the molding surface would then move away from the print media using the roller 22.

It must be noted that the informational image would generally only be present in the areas of the print media in which there is ink. It is possible in any of the embodiments discussed here to apply the informational image onto areas of the print substrate where there is no ink. The print media would need to be first coated with a substantially clear layer of radiation-curable material that would allow the pattern to be cured into the areas of the print media where there would otherwise be no ink. After the ink is dispensed on top of this layer of radiation-curable material, the entire print media would be molded and cured, forming the informational image in all regions of the print media, whether a region with ink or not. Alternatively, the substantially clear material may be printed selectively into the regions that do not receive colored ink or the clear material may be deposited as a continuous layer on top of the printed colored ink. For purposes of this discussion, the term 'printed image' will include those areas that do not receive ink.

Figure 4:
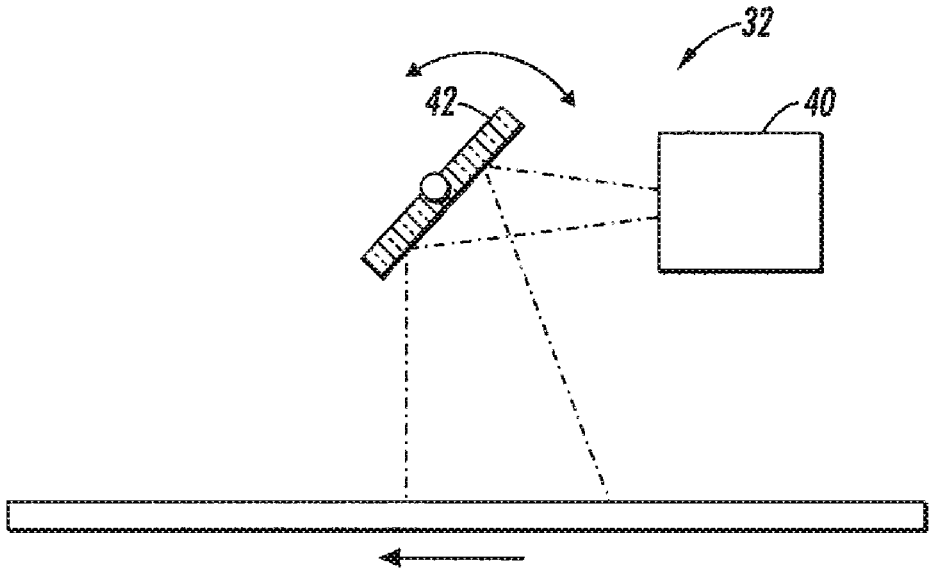
FIG. 4 shows an embodiment of an illumination system that can image on a moving printed image.
Figure 5:
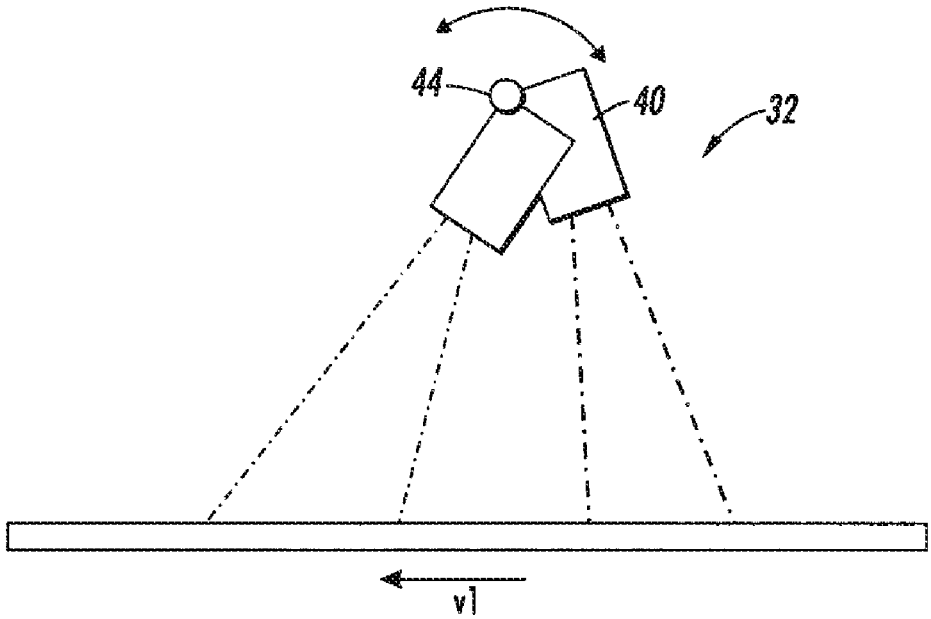
FIG. 5 shows an alternate embodiment of an illumination system that can image on a moving printed image.

Formation of the informational image using the two-step curing process of FIG. 3 may require some attention with regard to the first projector. The curing radiation source 32 should be able to cure the ink within the imaged region very quickly to avoid image blurring. One possible approach is to use a high intensity arc lamp, such as a Xenon flash lamp. An alternative is to 'move' the image with the media as it traverses the space between the rollers. FIGS. 4 and 5 show different embodiments of possible approaches for the first curing source 32.

In FIG. 4, the curing source 32 of FIG. 3 includes a radiation source 40 and a scanning mirror 42. The mirror 42 would then pivot and cause the image to move along with the print media in the direction of the arrow shown. Generally, the pivot of the scanning mirror 42 will be timed to move in conjunction with the print media, to avoid image artifacts in the informational image.

FIG. 5 shows an alternative approach. The light source 40 could itself pivot as shown by its original position and position 44. This could cause the image to travel along with the print media as it moves, keeping the same region exposed as it travels. This allows for sufficient curing to avoid blurring or streaking the information image within the printed image. Of course these are only two examples and many other mechanisms may be used to move the projected image with the print media.

Figure 6:
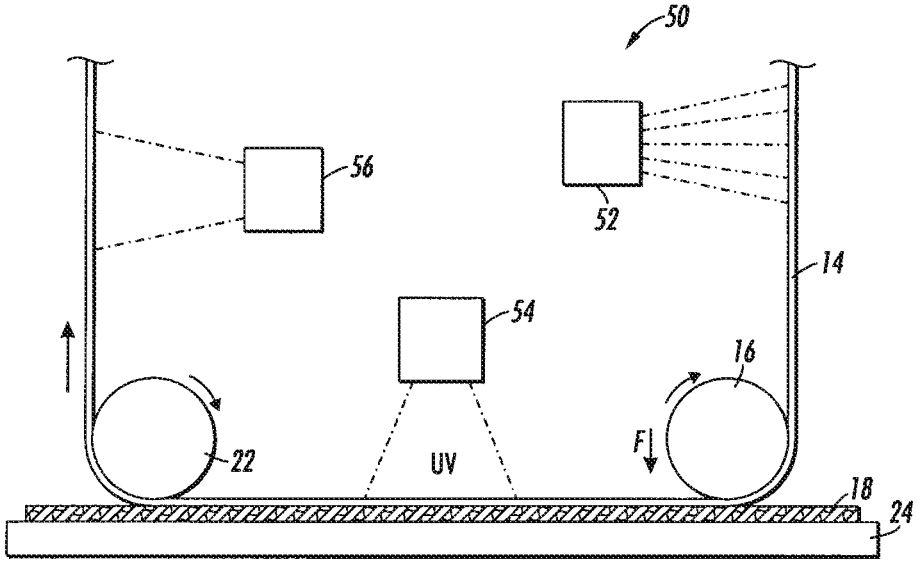
FIG. 6 shows an embodiment of a printing and molding system using a photo-sensitive molding surface.

Using a molding process that operates directly on the molding surface such as the approach in FIG. 1 alleviates the issues with having to move the molding image with the print media. A direct molding process that has more flexibility in changing the molding surface would have other advantages. FIG. 6 shows an embodiment of a system that can perform molding directly on the molding surface.

The printing system 50 employs a photo-sensitive polymer as the molding surface. A type of photo-sensitive polymers, sometimes referred to as shape memory polymers, can be modified through photo-cross linking to cause some of the monomer groups to transition from their rubbery state to the glassy state having a higher elastic modulus when exposed to a particular wavelength of light. In some cases the cross-linking is reversible by exposing the polymer to a different wavelength of light. Thus it is possible to produce a light-activated shape-memory polymer that could be deformed, held in the deformed shape by photo-irradiation using one wavelength and then be recovered to the original shape by irradiation with a different wavelength. This type of polymer may provide an 'erasable' molding surface. The deformation of the polymer could occur by mechanically pressing the polymer, such as via a roller mechanism. Or it may be possible to simply form a polymer molding surface that has soft and hard regions. Under the pressure of the roller 16, the soft and hard regions would leave impressions with different shape or depth in the ink layer. Photo-responsive polymers have been described in an article by E. A. Snyder, et al. "Towards Novel Light-Activated Shape Memory Polymer: Thermomechanical Properties of Photo-responsive Polymers," Spring MRS 2005. Other photo-sensitive polymers may also be used, more generally light-sensitive polymers.

In FIG. 6, a first radiation source 52 can image the informational image onto the molding surface 14. An image projector using a micromirror array would be an example of a radiation source. The molding surface would consist of a photo-sensitive polymer such as a photo-sensitive shape-memory polymer or a different material with a photo-sensitive polymer coating. The molding surface would transfer the informational image to the ink layer 18 as it comes into contact with the ink layer 18 via roller 16. The second radiation source 54 then cures the printed image with the informational image and the molding surface moves out of contact with the now-cured ink layer via roller 22.

Using a different wavelength radiation, the radiation source 56 would then reverse the informational imaging process. The informational image was formed by turning the photo-sensitive polymer glassy using a first wavelength and can be reverse by returning it to its rubbery state using a second wavelength of light. The radiation source 56 would transmit light of the second wavelength to blank expose the molding surface and therefore cause the photo-sensitive polymer to be 'erased' allowing it to be re-imaged with the next informational image as needed.

Figure 7:
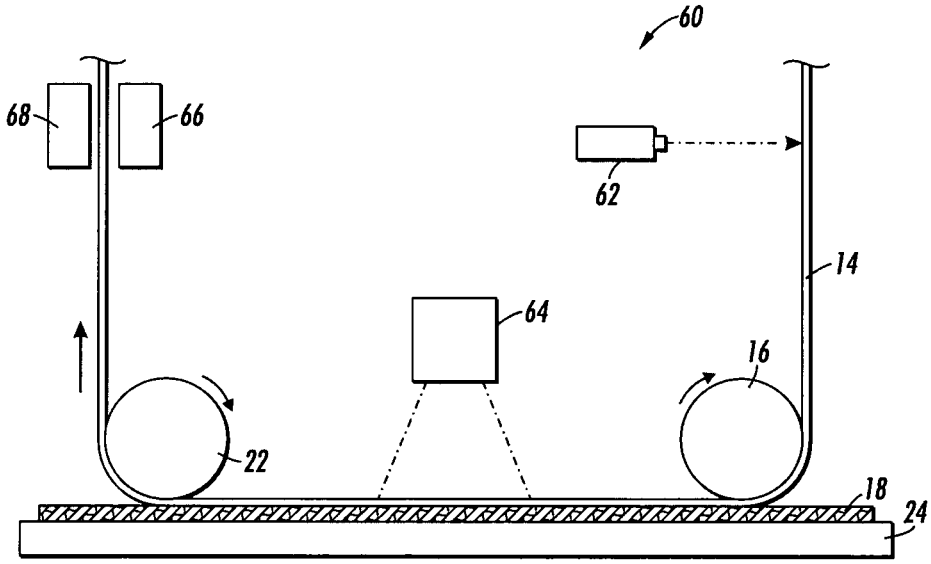
FIG. 7 shows an alternative embodiment of a printing and molding system using a photo-sensitive molding surface.

The molding surface could also consist of a heat-sensitive polymer similar to the photo-sensitive polymer as shown in FIG. 7. The radiation source that forms the image may consist of an infrared laser such as 62. The laser would write the informational image into the molding surface 14, irradiated regions become glassy and can be deformed and upon cooling the shape remains, which may consist of a heat-sensitive polymer that may or may not be a shape memory polymer or a layer of heat-sensitive polymer on the surface of another material.

The informational image formed by the infrared laser would then be formed into the ink layer as discussed above. The radiation source 64 would then cure the ink of the printed image to also include the informational image. Once the molding surface moves out of contact with the ink layer, the informational message could be erased. One approach would heat the molding surface with a heater 66 and then press the heated molding surface with another smooth surface such as 68. This would smooth out the informational image from the molding surface, making it suitable for re-use for other informational images.

In this manner, an informational image may be superimposed upon a printed image, either by direct imaging of the informational image through the molding surface, or by forming the image in the molding surface and transferring it to the printed image.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A system, comprising:

a print head to dispense ink onto a print surface to form a printed image;

a molding surface to contact the ink to form an informational image in at least the surface of the ink;

a radiation source to solidify the ink into the printed and informational images;

a second radiation source to project the informational image onto the print surface; and a transport mechanism to press the molding surface at a first pressure while the informational image is projected on the print image to solidify the ink in areas of the informational image and at a second pressure while a second radiation source solidifies the remaining ink regions.

2. The system of claim 1, further comprising a release mechanism to move the molding surface away from the ink.

3. The system of claim 1 further comprising one of a mechanical printer, an inkjet printer, or a laser printer to print an informational image onto the molding surface.

4. The system of claim 1, wherein the second radiation source comprises one of a high intensity flash lamp, a moving projected image, or a combination of light source and scanning mirror.

5. The system of claim 1, wherein the molding surface comprises one of either a photo-sensitive or a shape-memory polymer.

6. The system of claim 5, further comprising:

the second radiation source to form an informational image into the molding surface prior to the molding surface contacting the ink, wherein the molding surface comprises a shape-memory polymer; and a third radiation source to erase the molded image from the molding surface after the radiation source cures the ink.

7. The system of claim 1, wherein the informational image is one of a topographical watermark, a logo, a message, a symbol, a hologram, a bar code, a two-dimensional bar-code, Braille code, topography for acoustic signals, and a surface texture.

8. A system, comprising:

a print head to dispense ink onto a print surface to foam a printed image;

a photo-sensitive molding surface to contact the ink to form an informational image in at least the surface of the ink;

an infrared laser to write the informational image onto the photo-sensitive polymer;

a radiation source to solidify the ink into the printed and informational images;

a heat source to heat the molding surface after contacting the ink; and a pressing surface to remove the informational image from the molding surface after heating.

* * * * *

UNITED STATES PATENT AND TRADEMARK OFFICE

CERTIFICATE OF CORRECTION

PATENT NO. : 8,152,290 B2
APPLICATION NO. : 12/324069
DATED : April 10, 2012
INVENTOR(S) : Jurgen H. Daniel et al.

It is certified that error appears in the above-identified patent and that said Letters Patent is hereby corrected as shown below:

On the title page, section (73), the Assignees Xerox Corporation, Norwalk, CT (US); Palo Alto Research Center Incorporated, Palo Alto, CA (US), should read -- Palo Alto Research Center Incorporated, Palo Alto, CA (US) --.

Signed and Sealed this
Fifth Day of March, 2013

Teresa Stanek Rea
*Acting Director of the United States Patent and Trademark Office*